US006997825B2

(12) United States Patent
Girard et al.

(10) Patent No.: US 6,997,825 B2
(45) Date of Patent: Feb. 14, 2006

(54) TOSS-GAME STRUCTURE FOR POOLSIDE USE

(75) Inventors: Alan M. Girard, Madison, IN (US); Robert W. Dunne, North Kingsville, OH (US); Ronald C. Midili, Hopatcong, NJ (US)

(73) Assignee: Meese, Inc., Saddle Brook, NJ (US)

( * ) Notice: Subject to any disclaimer, the term of this patent is extended or adjusted under 35 U.S.C. 154(b) by 646 days.

(21) Appl. No.: 10/162,930

(22) Filed: Jun. 5, 2002

(65) Prior Publication Data

US 2003/0227137 A1 Dec. 11, 2003

(51) Int. Cl.
*A63B 67/00* (2006.01)

(52) U.S. Cl. ..... 473/466; 473/476; 273/398

(58) Field of Classification Search ..... 473/465, 473/466, 476; 273/400–402, 393, 357, 389, 273/407, 317.1–317.3, 317.5, 388, 385, 398
See application file for complete search history.

(56) References Cited

U.S. PATENT DOCUMENTS

| | | | | | |
|---|---|---|---|---|---|
| 768,397 | A * | 8/1904 | Norton et al. | ..... | 273/389 |
| 827,626 | A * | 7/1906 | Gillet | ..... | 273/402 |
| 858,990 | A * | 7/1907 | Kemper | ..... | 273/394 |
| 1,547,171 | A * | 7/1925 | Huttlin | ..... | 273/407 |
| 3,201,126 | A * | 8/1965 | Nissen | ..... | 273/393 |
| 3,643,950 | A * | 2/1972 | Holk | ..... | 273/394 |
| 3,790,174 | A * | 2/1974 | Skillern | ..... | 273/394 |
| 4,215,867 | A * | 8/1980 | Natwick | ..... | 273/357 |
| 4,245,842 | A * | 1/1981 | Kuna et al. | ..... | 273/357 |
| 4,613,136 | A | 9/1986 | Raba et al. | | |
| 5,112,023 | A * | 5/1992 | Sowers | ..... | 248/519 |
| 5,320,360 | A * | 6/1994 | St. Pierre | ..... | 273/402 |
| 5,704,612 | A * | 1/1998 | Kelly et al. | ..... | 273/402 |
| 6,179,295 | B1 * | 1/2001 | Lanza | ..... | 273/402 |

FOREIGN PATENT DOCUMENTS

| | | |
|---|---|---|
| CA | 2111824 | 6/1995 |

* cited by examiner

*Primary Examiner*—Gregory Vidovich
*Assistant Examiner*—M. Chambers
(74) *Attorney, Agent, or Firm*—Drinker Biddle & Reath LLP

(57) ABSTRACT

A toss-game structure for poolside use includes a target supported at a height from a base and having front and rear portions defining an interior space. The target front portion includes at least one opening for receipt of a tossed object in the interior space. The target portions each have surfaces defining a portion of a substantially prolate sphere for collectively simulating a football shape. A support post includes opposite ends engaging the base and the target rear portion such that a majority of the target is positioned forwardly of a front edge of the base. The structure further includes a backstop having upper and lower portions. The upper portion is curved about a vertical axis to define a concave surface in the form of a partial cylinder. The lower portion is curved about horizontal and vertical axes in the form of a partial bowl.

17 Claims, 4 Drawing Sheets

TOSS-GAME STRUCTURE FOR POOLSIDE USE

FIELD OF THE INVENTION

The present invention relates to structures used in games of toss, and more particularly to freestanding structures that provide a target for a tossed object, such as a ball for example.

BACKGROUND OF THE INVENTION

In toss-game structures in the general field of the present invention, a target is provided for receiving a tossed object. In basketball for example, arguably the best known of such target games, a horizontally oriented hoop is supported at an elevated height with respect to a playing surface for receiving a tossed ball. Numerous constructions are known for providing a horizontal hoop for basketball. In its original form, a bottomless basket was secured to the wall of a structure adjacent a playing surface. The upper end of the basket formed the horizontal hoop for receiving a round ball. The wall of the basket provided a useful channeling function to downwardly direct a received ball. A rim and net construction replaced the original basket, with the rim providing a horizontal hoop target and the net providing for downward channeling of a received ball.

A variety of structures are known for supporting a horizontal rim at an elevation to provide for a game of basketball. The rim is typically secured to a backboard that includes a vertically oriented, and planar, surface. For indoor play, the backboard is secured to the wall of a structure, such as a gymnasium for example. For outdoor play, a pole is embedded in the ground to provide for elevated support of the backboard adjacent to a playing surface. It is also known to provide a wheeled base suitably weighted for stable support of the backboard and pole. Such freestanding structures provide the advantage of portability over embedded backboard support poles.

Toss-game structures have also been adapted for use adjacent to swimming pools. U.S. Pat. No. 4,613,136 to Raba et al., for example, discloses a basketball structure adapted for use adjacent a swimming pool. The structure includes a horizontal basketball rim connected to a vertical planar surface of a backboard. Because the pool bottom is at a lower elevation than the poolside surface, the height at which the backboard must be supported from the poolside to position the horizontal rim sufficiently above the game participants is less than for basketball court construction. The Raba '136 structure includes a hollow base that may be filled with water or other suitable ballast to provide for a stable freestanding structure.

The backboard of the Raba '136 structure includes "wing" portions of the front side surface extending along its edges that are angled with respect to the major, central portion of the front side surface. All of the front side surfaces, including the wings, however, are planar surfaces. Furthermore, the central portion that is not angled occupies the majority of the front side surface. This provides for traditional basketball play in which a round ball is directed to the horizontal hoop by banking the ball off the backboard in addition to direct arcs of the ball from the participant to the hoop.

As described above, the poolside toss-game structure disclosed in Raba '136 is directed to a basketball type of toss-game in which a horizontal hoop is secured to a planar surface of a backboard for receiving a round ball. Raba '136 does not disclose or suggest a poolside structure in which the target element is not horizontally oriented or adapted for receipt of a round ball. Raba '136 also does not disclose or suggest a construction in which the target element is not secured to the backboard. As described above, the direct connection between the hoop and backboard in the manner disclosed in Raba '136 facilitates conventional basketball play in which the hoop may be targeted by banking shots off of the backboard.

SUMMARY OF THE INVENTION

According to the present invention, there is provided a structure for use in a swimming pool game of toss. The structure includes a base providing for freestanding support of the structure at an edge of a swimming pool. The structure further includes a target supported on the base in a substantially upstanding orientation with respect to a length of the target. The target includes front and rear portions defining an interior space therebetween, the front portion having at least one opening to provide for receipt of a tossed object within the interior space. The structure further includes a backstop supported by the base such that at least a portion of the backstop is located rearwardly of the target for contact with an object tossed beyond the target from the swimming pool.

The front and rear portions of the target preferably include surfaces defining portions of a substantially prolate sphere for simulating a football shape. The target preferably includes front and rear portions defining a hollow interior therebetween. The structure also preferably includes a support post received in recesses defined in the base and in the target rear portion for positioning a majority of the target forwardly of a front edge of the base. The recesses defined by the base and the target rear portion preferably include a cylindrical central portion for receiving the support post and opposite slotted portions for receiving locking pins extending through openings in the support post to limit relative rotation between the post and the target rear portion and between the post and the base.

The base preferably includes an access hole communicating with an interior of the base to provide for receipt by the base of a ballast substance. The backstop of the structure preferably includes upper and lower portions each having a curved surface. The surface of the backstop upper portion is preferably curved about a vertical axis in the form of a partial cylinder. The surface of the backstop lower portion is preferably curved about vertical and horizontal axes in the form of a partial bowl.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE PREFERRED EMBODIMENT

Figure 1:
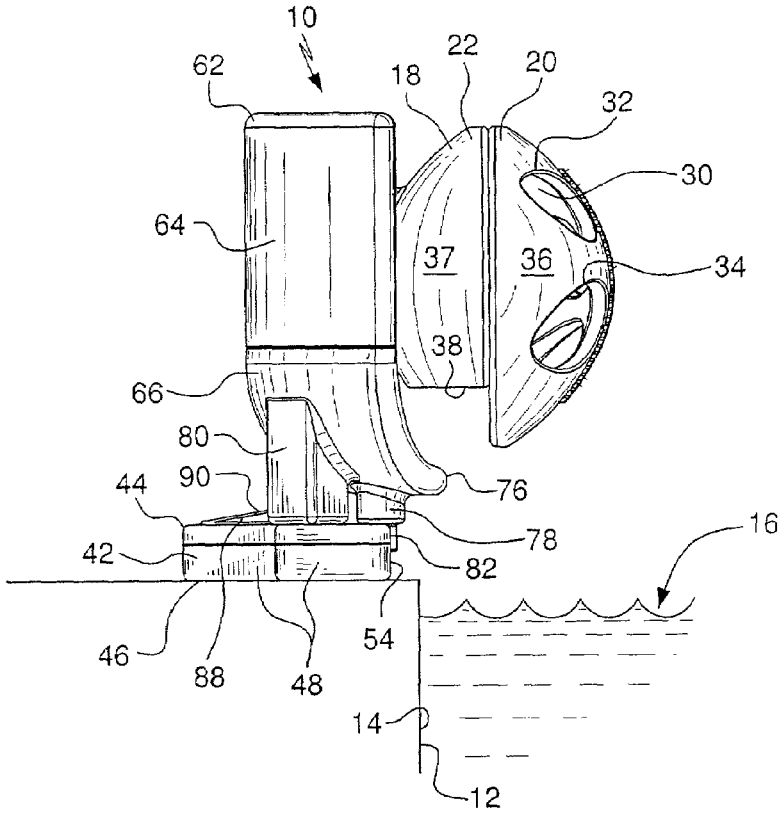
FIG. 1 is a side view of a toss-game structure according to the present invention positioned beside the edge of swimming pool.

Referring to the drawing figures where like reference numerals refer to like elements, there is shown a structure 10 according to the present invention for use in a toss game. The structure 10 is shown in FIG. 1 positioned adjacent to an edge 14 of a swimming pool 12 for use by persons (not shown) located in a playing area 16 of the swimming pool 12. Directional terms used herein, such as "upper", "lower", "vertical" and "horizontal", refer to the structure 10 when supported in an upstanding orientation, as shown in FIG. 1. Directional terms such as "front", "rear", "forward", "rearward", refer to structure 10 with respect a playing area, such as playing area 16 of swimming pool 12, from which objects would be tossed to structure 10.

Figure 6:
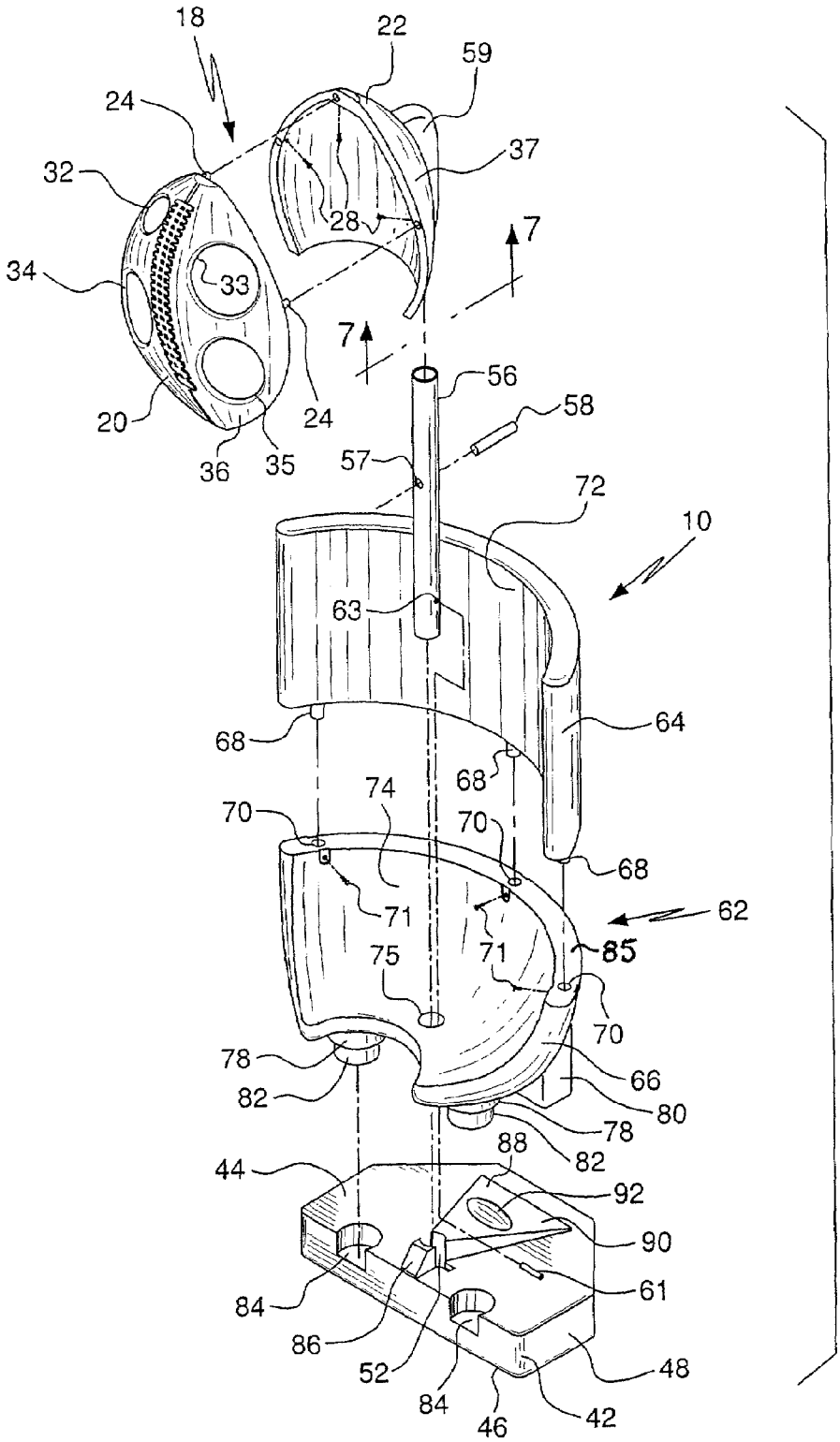
FIG. 6 is an exploded perspective view of the toss-game structure of FIG. 1.

The structure 10 includes a target 18 forwardly supported with respect to the structure 10. As will be described in greater detail, the target 18 is adapted for receiving a tossed object, such as a ball (not shown), directed at the target 18 from the playing area 16. The target 18 includes front and rear portions 20, 22. As shown in FIG. 6, the front portion 20 of the target 18 includes pegs 24 that are slidably received in cooperatively formed recesses 26 in the rear portion 22. The front and rear portions 20, 22 of the target 18 are secured together by screws 28 extending through the rear portion 22 and received by the pegs 24 of the front portion 20.

Figure 2:
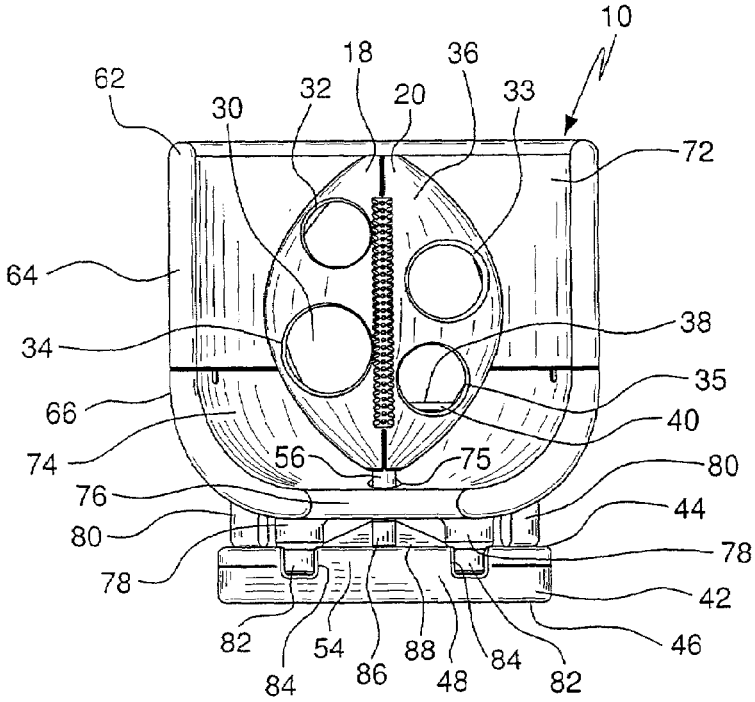
FIG. 2 is a top plan view of the toss-game structure of FIG. 1.

The front and rear portions 20, 22 of target 18 define a hollow interior 30 therebetween. The front portion 20 includes openings 32, 33, 34, 35 communicating with the interior 30 of the target 18 to provide for passage of a tossed object, such as a miniature football for example, through the front portion 20 into the interior 30. As shown in FIG. 2, openings 33, 34 are relatively large compared to openings 32, 35 with opening 34 being the largest. As a result, the probability that a tossed object will pass through openings 33, 34 is greater than that for openings 32, 35. Such a construction could be used in a football-type game, for example, in which three points (a "field goal") are awarded for passage of a miniature football through openings 33, 34 and six points (a "touchdown") are awarded for openings 32, 35.

Figure 3:
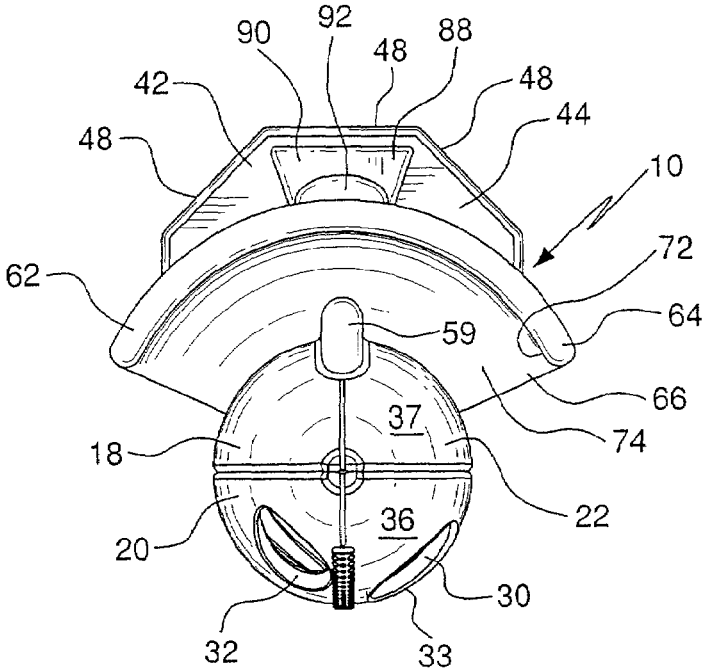
FIG. 3 is a bottom plan view of the toss-game structure of FIG. 1.
Figure 4:
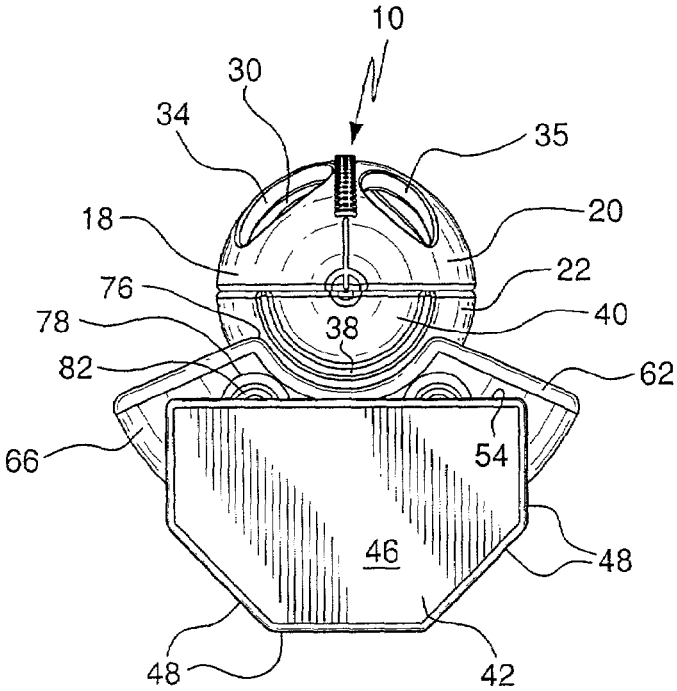
FIG. 4 is a front elevation view of the toss-game structure of FIG. 1.

The target 18 is supported by the structure 10 such that the front and rear portions 20, 22, extend in a substantially upstanding fashion. The upstanding support of the front portion 20 in this manner positions the openings 32–35 forwardly, as shown in FIGS. 3 and 4, providing for presentation of the openings 32–35 to users of the structure 10, positioned in playing area 16 of swimming pool 12, for example.

The front and rear portions 20, 22 of the target 18 have curved walls such that outer surfaces 36, 37 of the front and rear portions 20, 22, respectively, define portions of a substantially prolate sphere. As shown, the prolate sphere portions defined by outer surfaces 36, 37 collectively simulate the shape of a football. The football appearance may be further enhanced, as shown, by including simulated lacing on outer surface 36 of front portion 20. As shown in FIGS. 1 and 4, rear portion 22 has a lower terminal end 38 that defines an exit opening 40 communicating with the interior 30 of the target 18. Objects received through the openings 32–35 in the front portion 20 will be directed downwardly by gravity toward the exit opening 40 in the rear portion 22. The exit opening 40 is sufficiently large to provide an exit path from the target 18 for objects received in the interior 30 through the openings 32–35 in the front portion 20.

As shown in FIG. 1, the forward location of the target 18 provides for positioning of the structure 10 such the exit opening 40 in rear portion 22 will be located over the playing area 16 of the swimming pool 12 adjacent the edge 14. Positioned in this manner, objects that are received in the interior 30 of the target 18 through openings 32–35 will be directed through the interior 30 for return to the playing area 16 via exit opening 40.

Figure 5:
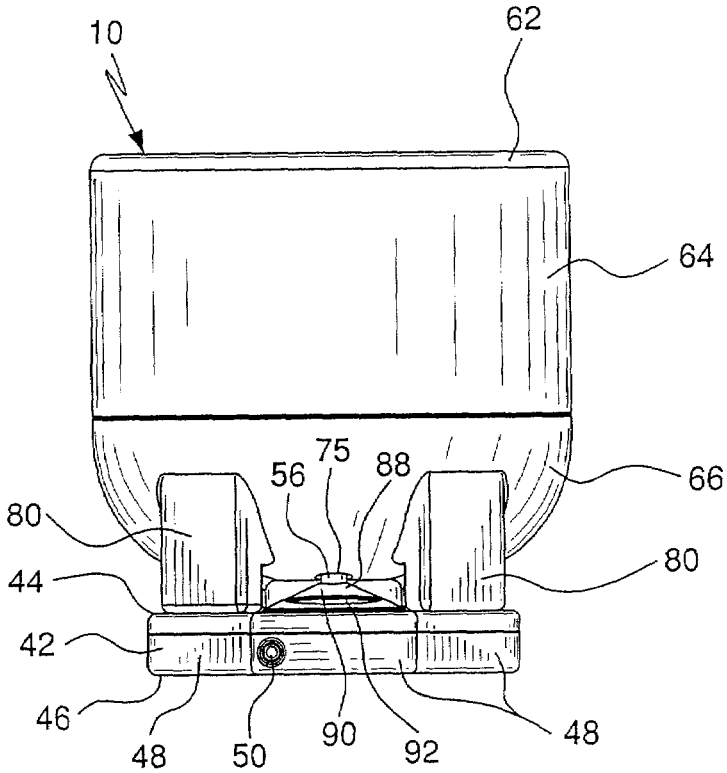
FIG. 5 is a rear elevation view of the toss-game structure of FIG. 1.

The structure 10 further includes a base 42 providing for freestanding support of the structure 10 on a surface, such as adjacent to the edge 14 of swimming pool 12 as shown in FIG. 1. The base 42 includes upper and lower surfaces 44, 46 and relatively short sides 48. The base 42 defines a hollow interior (not shown) and includes an access hole 50 (FIG. 5) in one of the sides 48 communicating with the interior of the base 42. The access hole 50 provides for filling of the interior of the base 42 with a ballast material, such as water or sand. The structure 10 preferably includes a removable plug to provide for filling and draining of the base 42. The ballast material adds sufficient weight to the base 42 to limit overturn of the structure 10.

Figure 7:
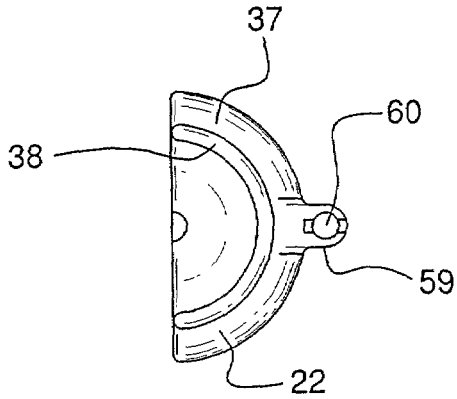
FIG. 7 is a bottom view of the rear portion of the target of FIG. 6.

An opposite end of the support post 56 engages the rear portion 22 of target 18 to support target 18 at a distance from the base 42. The rear portion 22 includes a post holder 59 formed integrally with the rear portion 22 to form a rearward part thereof. As shown in FIG. 7, the post holder 59 defines a recess 60 that includes a cylindrical center portion and opposite slotted portions. The cylindrical center portion of recess 60 receives post 56 and the opposite slotted portions receives a locking pin 61 extending through openings 63 on opposite sides of post 56, in a similar manner to pin 58, to lock the target 18 against rotation with respect to the post 56. Support of the target 18 in this manner positions the exit opening 40 of the rear portion 22 forwardly of the front edge 54 of the base 42 to provide for the return of objects to the playing area 16 of swimming pool 12, for example.

An opposite end of the support post 56 engages the rear portion 22 of target 18 to support target 18 at a distance from the base 42. As shown in FIG. 7, the rear portion 22 includes a post holder 59 formed integrally with the rear portion 22 to form a rearward part thereof. The post holder 59 defines a recess 60 that includes a cylindrical center portion and opposite slotted portions. The cylindrical center portion of recess 60 receives post 56 and the opposite slotted portions receives a locking pin 61 extending through openings 63 on opposite sides of post 56, in a similar manner to pin 58, to lock the target 18 against rotation with respect to the post 56. Support of the target 18 in this manner positions the exit opening 40 of the rear portion 22 forwardly of the front edge 54 of the base 42 to provide for the return of objects to the playing area 16 of swimming pool 12, for example.

The structure 10 further includes a backstop 62 located rearwardly of the target 18 for retaining tossed objects passing beyond the target 18 and returning them to the playing area 16 of a swimming pool 12, for example. As shown in the exploded perspective of FIG. 6, the backstop 62 includes upper and lower portions 64, 66. The backstop upper portion 64 includes pegs 68 extending from a lower edge for receipt in recesses 70 formed in an upper edge of the backstop lower portion 66. The backstop upper and lower portions 64, 66 are secured together by screws 71 received by the pegs 68.

The backstop upper portion 64 is curved such that a forward surface 72 thereof presents a concavely curved surface to participants of a toss game. As shown in FIG. 3, the forward surface 72 is curved about a vertical axis such that it is substantially a portion of a cylinder. The inclusion of the cylindrically curved forward surface 72 in backstop upper portion 64 provides for a focused return of tossed objects inwardly with respect to the structure 10. In a similar fashion to the backstop upper portion 64, the backstop lower portion 66 includes a forward surface 74 that is curved about a vertical axis to provide for inward direction of tossed object with respect to the structure 10. The forward surface 74 of backstop lower portion 66 is further curved about horizontal axes, as shown in FIGS. 2 and 6, such that the surface 74 is substantially bowl shaped. The bowl shape defined by the backstop lower portion 66 provides for downward channeling of tossed objects towards a lower edge 76 of the backstop lower portion 66.

The backstop lower portion 66 includes an opening 75 adjacent the lower edge 76 to provide for receipt of the support post 56. As shown in FIG. 4, the backstop 62 is positioned such that the lower edge 76 of the backstop 62 is substantially aligned with the exit opening 40 of the target 18. In this manner, tossed objects will exit from the interior 30 of the target 18 to the playing area 16 of the swimming pool 12, for example, in substantially the same location as objects returned from the backstop 62.

The lower portion 66 of backstop 62 includes front and rear legs 78, 80 to provide for support of the backstop 62. The rear legs 80 are relatively long compared to the front legs 78 to accommodate the bowl shaped curvature of the lower portion 66. A lower portion 82 of the front legs 78 has a reduced diameter adapted for receipt in recesses 84 formed in the upper surface 44 of the base 42 along the front edge 54 of base 42. As described above, the base 42 preferably defines a hollow interior that is filled with water or sand to provide ballast. To facilitate portability and material efficiency, other components such as the backstop 62 are also preferably formed to include hollow interiors. In such a case, it may be desirable to provide additional ballast to that provided by the filled base 42. An access hole could be provided in surface 85 of the backstop lower portion 66 for directing water into the hollow interior. Because of the relatively large size of the backstop 62, a partial fill of the backstop lower portion 66, should provide sufficient ballast for structure 10.

The structure 10 includes front and rear buttresses 86, 88 formed integrally with the base 42 and extending from upper surface 44 adjacent the recess 52 to reinforce the support post 56. As shown in FIGS. 3 and 6, the rear buttress 88 is elongated rearwardly to define a relatively gently sloping upper surface 90. A depression 92 formed in the upper surface 90 of rear buttress 88 provides a convenient location for placement of a game object, such as a miniature football (not shown), for example.

The components of the structure 10 are preferably made from linear low-density polyethylene. The components are further preferably formed in a roto-molding process. It is not required by the present invention, however, that the components be linear low-density polyethylene or that they be formed in a roto-molding process. The components of structure 10 could be made from other materials in other processes such as thermoplastic materials in an injection molding process, for example. Although the toss-game structure 10 has been described above for use adjacent a swimming pool, the present invention is not so limited. The toss-game structure 10 could be used in other settings, such as supported on a table within a carnival booth, for example While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather should be construed in breadth and scope in accordance with the recitation of the appended claims.

What is claimed is:

1. A freestanding toss-game structure comprising:

a base having a front edge;

a target having a length and supported on the base in a substantially upstanding orientation with respect to the length, the target including front and rear portions defining an interior space therebetween, the front portion of the target located forwardly of the rear portion, the front portion includes a convex surface and including communicating with the interior space to provide for receipt of a tossed object within the interior space; and a backstop supported by the base such that at least a portion of the backstop is located rearwardly of the target for contact with an object tossed beyond the target from a forward location with respect to the structure, the target and backstop supported such that a space is defined between the backstop and the rear portion of the target.

2. The toss-game structure according to claim 1, wherein the convex surface of the target front portion defines a portion of a substantially prolate sphere.

3. The toss-game structure according to claim 2, wherein each of the front and rear portions of the target includes a surface defining a portion of a substantially prolate sphere such that the front and rear portions collectively simulate a football shape.

4. The toss-game structure according to claim 1, wherein the base includes an access hole communicating with a hollow interior of the base to provide for receipt of a ballast substance by the base.

5. The toss-game structure according to claim 1, further comprising a support post having opposite ends engaging the base and the target to support the target at a distance from the base.

6. The toss-game structure according to claim 5, wherein a first end of the support post is received in a recess formed in the base adjacent the base front edge and wherein an opposite second end of the support post engages the target rear portion such that a majority of the target is positioned forwardly of the base front edge.

7. The toss-game structure according to claim 1, wherein the backstop includes a surface that is concavely curved about a vertical axis.

8. A freestanding toss-game structure comprising:

a base having a front edge;

a target having a length and supported on the base in a substantially upstanding orientation with respect to the length, the target including front and rear portions defining an interior space therebetween, the front portion including at least one opening communicating with the interior space to provide for receipt of a tossed object within the interior space; and a backstop supported by the base such that at least a portion of the backstop is located rearwardly of the target for contact with an object tossed beyond the target from a forward location with respect to the structure, wherein the backstop includes upper and lower portions each having a curved surface, the surface of the upper portion of the backstop being curved about a vertical axis in the form of a partial cylinder, the surface of the lower portion being curved about horizontal and vertical axes in the form of a partial bowl.

9. The toss-game structure according to claim 1, wherein the backstop includes a plurality of legs for supporting the backstop at a distance from the base, at least one of the legs including a portion received by a recess defined by the base.

10. The toss-game structure according to claim 1, wherein the target includes a plurality of substantially circular openings and wherein at least one of the openings has a diameter that differs from that of the other openings.

11. A structure for use in a game of toss, the structure comprising:

a base having a front edge, the base adapted for free-standing support of the structure with the front edge located adjacent the edge of a playing area;

a target supported on the base, the target defining an interior space and having at least one opening communicating with the interior space for receipt of a tossed object in the interior space; and a backstop supported by the base such that at least a portion of the backstop is located rearwardly of the target for contact with an object tossed beyond the target from the playing area, the backstop having upper and lower portions with the upper portion supported by the lower portion, the upper portion including a surface curved about a vertical axis in the form of a partial cylinder, the lower portion including a surface curved about vertical and horizontal axes in the form of a partial bowl.

12. The toss-game structure according to claim 11, wherein the target includes front and rear portions having outer surfaces that are curved to define portions of substantially prolate spheres such that the portions collectively simulate a football shape.

13. The toss-game structure according to claim 12, wherein a post holder defining a recess is integrally formed with the rear portion of the target and wherein the base defines a recess in an upper surface of the base, the structure further comprising an elongated post for supporting the target at a distance from the base, the post including opposite first and second ends received by the post holder and the base recess, respectively.

14. The toss-game structure according to claim 13, wherein the support post defines a hollow cylinder and wherein each of the recesses in the post holder and the base includes a central cylindrical portion and opposite slotted portions, the slotted portions of the recesses adapted for receipt of first and second locking pins extending through openings in the support post, the first and second locking pins limiting relative rotation between the target and the support post and between the support post and the base.

15. A toss-game structure comprising:

a base having a front edge;

a target having opposite front and rear portions defining an interior space therebetween, the front portion including a plurality of openings to provide for receipt of a tossed object in the interior space through one of the front portion openings, each of the front and rear portions having an outer surface defining a portion of a substantially prolate sphere such that the front and rear portions collectively simulate a football shape, at least one of the front and rear portions having a lower end defining an exit opening for gravity discharge of an object from the interior space;

an elongated support post having a first end received in a recess defined by the upper surface of the base adjacent a front edge of the base, the post having an opposite second end engaging the rear portion of the target such that at least a portion of the target is positioned forwardly of the base front edge; and a backstop supported by the base such that at least a portion of the backstop is located rearwardly of the target for contact with an object tossed beyond the target from a forward location with respect to the structure.

16. The toss-game structure according to claim 15, further comprising front and rear support buttresses extending from an upper surface of the base adjacent the base recess, the buttresses adapted for reinforcement of the support post.

17. The toss-game structure according to claim 16, wherein the rear support buttress extends rearwardly on the base to define a relatively gently sloping surface, the rear buttress including a depression in the upper surface adapted for storage of a toss-game object.

* * * * *